US005326018A

United States Patent [19]

Baugus

[11] Patent Number: 5,326,018

[45] Date of Patent: Jul. 5, 1994

[54] CONTAINER CORNER STRUCTURE AND CONTAINER BLANK TOGETHER WITH A METHOD OF FORMING A CONTAINER CORNER STRUCTURE

[75] Inventor: Gary W. Baugus, Atlanta, Ga.

[73] Assignee: The Mead Corporation, Dayton, Ohio

[21] Appl. No.: 99,630

[22] Filed: Jul. 30, 1993

[51] Int. Cl.[5] ..... B65D 5/24

[52] U.S. Cl. ..... 229/187; 229/186; 229/190

[58] Field of Search ..... 229/186, 187, 190, 197

[56] References Cited

U.S. PATENT DOCUMENTS

| | | | |
|---|---|---|---|
| 1,985,778 | 12/1934 | Himes | 229/187 X |
| 2,295,532 | 9/1942 | Hyndman et al. | 229/187 |
| 2,646,916 | 7/1953 | Meller | 229/187 X |
| 3,358,901 | 12/1967 | Wainberg | 229/187 |
| 3,608,811 | 9/1971 | Frick | 229/187 |
| 3,738,564 | 6/1973 | Persson | 229/190 X |
| 4,187,977 | 2/1980 | Boykin et al. | 229/190 X |
| 4,978,020 | 12/1990 | Aono | 229/190 X |
| 5,195,644 | 3/1993 | Schmid | 229/190 X |

*Primary Examiner*—Allan N. Shoap
*Assistant Examiner*—Christopher McDonald
*Attorney, Agent, or Firm*—Rodgers & Rodgers

[57] ABSTRACT

A container having a bottom panel of quadrilateral configuration includes side walls foldably joined to side edges of the bottom panel, end walls foldably joined to end edges of the bottom panel, web structure at each corner of the container which is foldably joined to ends of adjacent side and end walls together with a locking tab foldably joined to each end edge of each end wall and defining a locking slit arranged to cooperate with a fastening slit for holding the web structure in collapsed condition and for holding the carton side and end walls in set up condition.

6 Claims, 2 Drawing Sheets

CONTAINER CORNER STRUCTURE AND CONTAINER BLANK TOGETHER WITH A METHOD OF FORMING A CONTAINER CORNER STRUCTURE

TECHNICAL FIELD

This invention relates to containers such as are normally formed of paperboard and which may include a box like structure having a bottom panel and upstanding side and end walls for receiving articles stacked atop the bottom panel.

BACKGROUND ART

U.S. Pat. No. 3,358,901 issued Dec. 19, 1967 discloses a container having a bottom wall, side walls foldably joined to the side edges of the bottom wall, end walls foldably joined to the end edges of the bottom panel, collapsible web structure at each corner of the carton together with locking flaps foldably joined to the end edges of each end panel together with a locking lip or tongue foldably joined to each locking flap which together with collapsible web structure is arranged to hold the carton in set up condition when the locking lip or tongue is arranged with an end edge in abutting contact with collapsible web structure to hold the carton in set up condition.

U.S. Pat. No. 3,608,811 issued Sep. 28, 1971 discloses a carton blank having a bottom panel and side and end wall panels foldably joined to the bottom panel together with web panels foldably joined together and foldably joined to the side and end walls respectively and a locking tab struck from one of said web panels and foldably joined to an end of one of said side walls.

SUMMARY OF THE INVENTION

A container having corner structure formed according to this invention and which utilizes a blank which is manipulated so as to set up the corner structure of the container includes a quadrilateral main panel having right angle corners together with side walls foldably joined to side edges of the main panel together with end walls foldably joined to end edges of the main panel, collapsible web structure joined at its ends to the adjacent end edges of a side and end wall along fold lines one of which terminates at a point spaced from the inner edge of the web structure to accommodate a locking slit extending from the inner edge of the web structure together with a locking tab foldably joined to the end edge of one end wall along a fold line to define a retention slit struck from the locking tab so as to define a projection of the adjacent end of an end wall panel, said locking tab having an aperture with an engagement edge which is engageable by a machine element to begin insertion of the locking tab which is disposed in flat face contacting relation with said one side wall and said locking slit and said retention slit being disposed in snug proximity to each other and an aperture defined by the inner edge of said web structure and the outer edge of said locking tab to accommodate folding movement of said locking tab.

BEST MODE OF CARRYING OUT THE INVENTION

Figure 1:
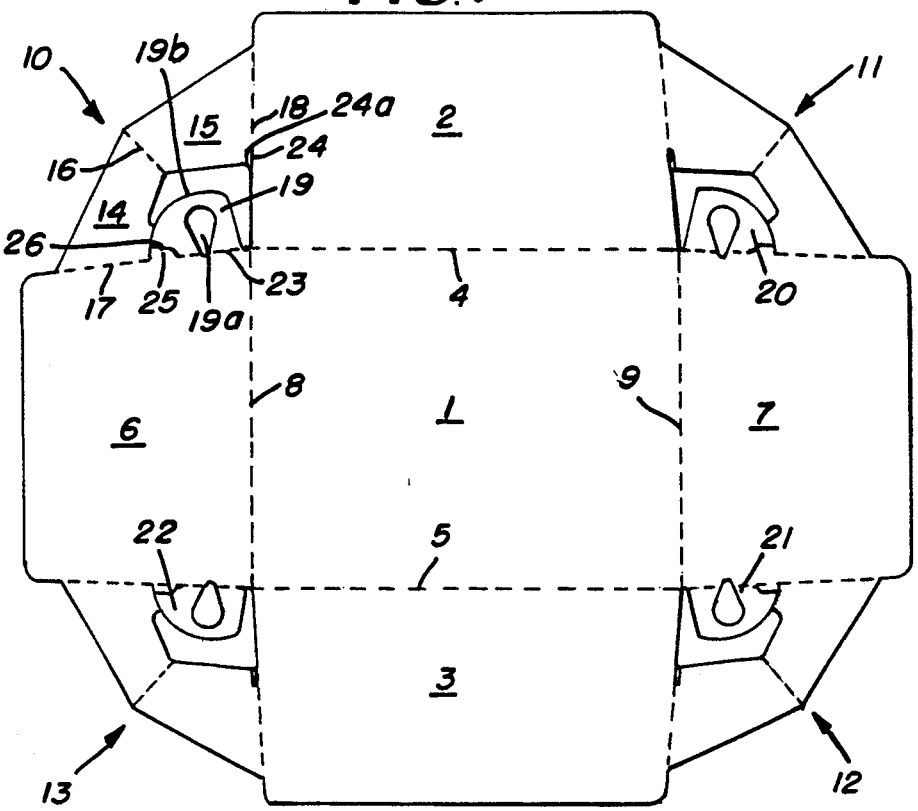
FIG. 1 is a plan view of a blank formed according to this invention.

With reference to FIG. 1, the numeral 1 designates the main panel of a carton formed according to this invention. The numerals 2 and 3 designate side walls foldably joined to main panel 1 along fold lines 4 and 5 respectively. End walls 6 and 7 are foldably joined to the ends of main panel 1 along fold lines 8 and 9 respectively.

Collapsible web structure is disposed at each corner of the blank and is designated by the numerals 10, 11, 12 and 13. All of these web structures are identical and only one such structure such as 10 is described here in detail. Web structure 10 comprises web panels 14 and 15 which are foldably joined to each other along fold line 16. Web panel 14 is foldably joined to the adjacent end of end wall 6 along fold line 17 and web panel 15 is foldably joined to the adjacent end edge of side wall 2 along fold line 18. A locking slit 24 is formed along the lower end of fold line 18 and includes an end portion **24*a* which extends into side wall 2**.

Locking tabs are disposed at each corner of the blank and are designated by the numerals 19, 20, 21 and 22.

Since all of the locking tabs 19–22 inclusive are of identical construction, only locking tab 19 is described in detail. All of said locking tabs include an arcuate outer edge portion such as **19*b* to aid in guiding the parts during set up operations. Locking tab 19 having an engagement aperture 19*a* is foldably joined to the adjacent end of end wall 6 along fold line 23. The engagement aperture 19*a* is of teardrop configuration with a wide end disposed within said locking tab and a narrow end disposed within the end wall and is provided to cooperate with a vertically disposed planar machine element E which moves inwardly on Chain C to engage aperture 19*a* followed by engagement with locking tab 19 and webs 14 and 15 as shown in FIG. 3A. The element E acts to fold locking tab and web panels through angles of more than 90 degrees so that the adjacent end panels may complete the set up operation. Fold line 23 terminates at a point spaced from the extremity of the locking tab 19 to define a retention slit 26 and a projection 25 which forms an integral extension of an end edge of side wall 6**.

Figure 3:
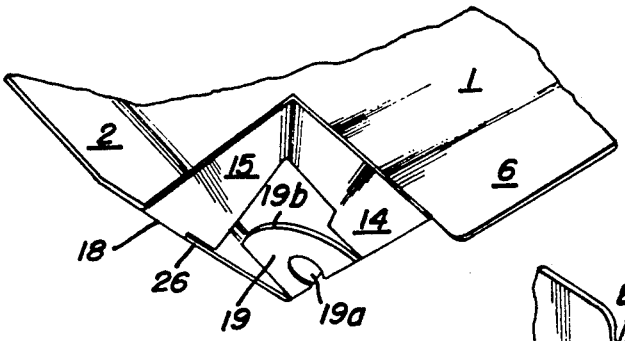
FIGS. 3, 3A, 4 and 5 illustrate stages through which the blank of-FIG. 1 is manipulated to form the completed set up container shown in FIG. 6.
Figure 3A:
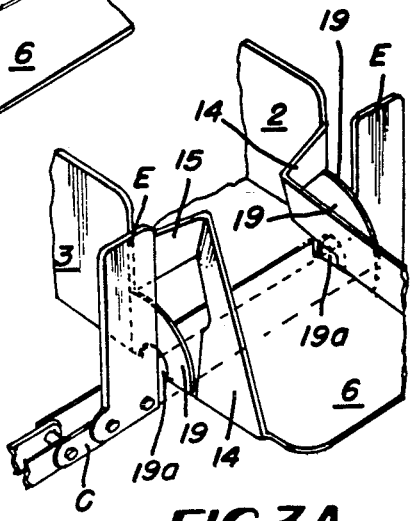

FIG. 3 shows one corner of the container in the early stages of a set up operation with the parts viewed from outside the corner. For instance, in FIG. 3, the webs 14 and 15 are folded inwardly and the locking tab 19 is folded partially toward its locking position.

Figure 4:
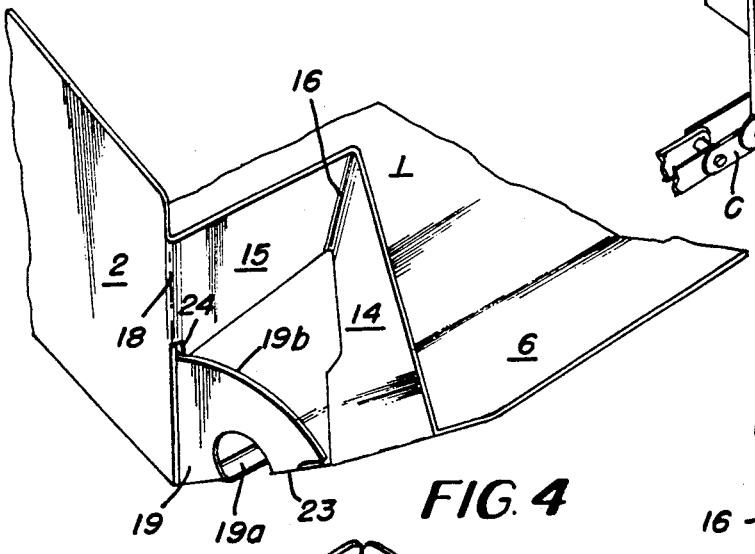

FIG. 4 depicts the corner structure shown in FIG. 3 from the outside and represents a further stage of a set up operation wherein locking tab 19 is approaching engagement with retention slit 26.

Figure 5:
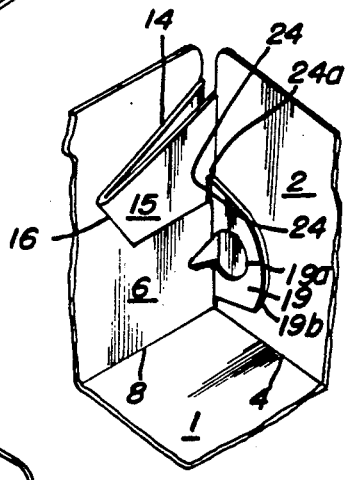

FIG. 5 shows the structure after the locking operation is completed and the locking slit 24 and **24*a* have engaged the retention slit 26** and the structure is complete.

Figure 6:
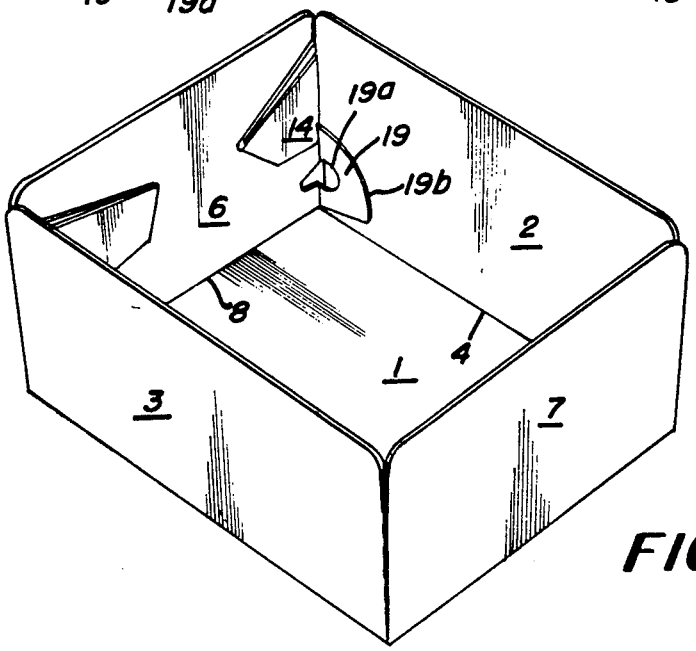

FIG. 6 simply shows a complete carton fully set up but without showing the bottles such as B1–B6. In FIG. 6 the locking tab 19 is disposed in flat face contacting relation with the side wall 2.

Figure 2:
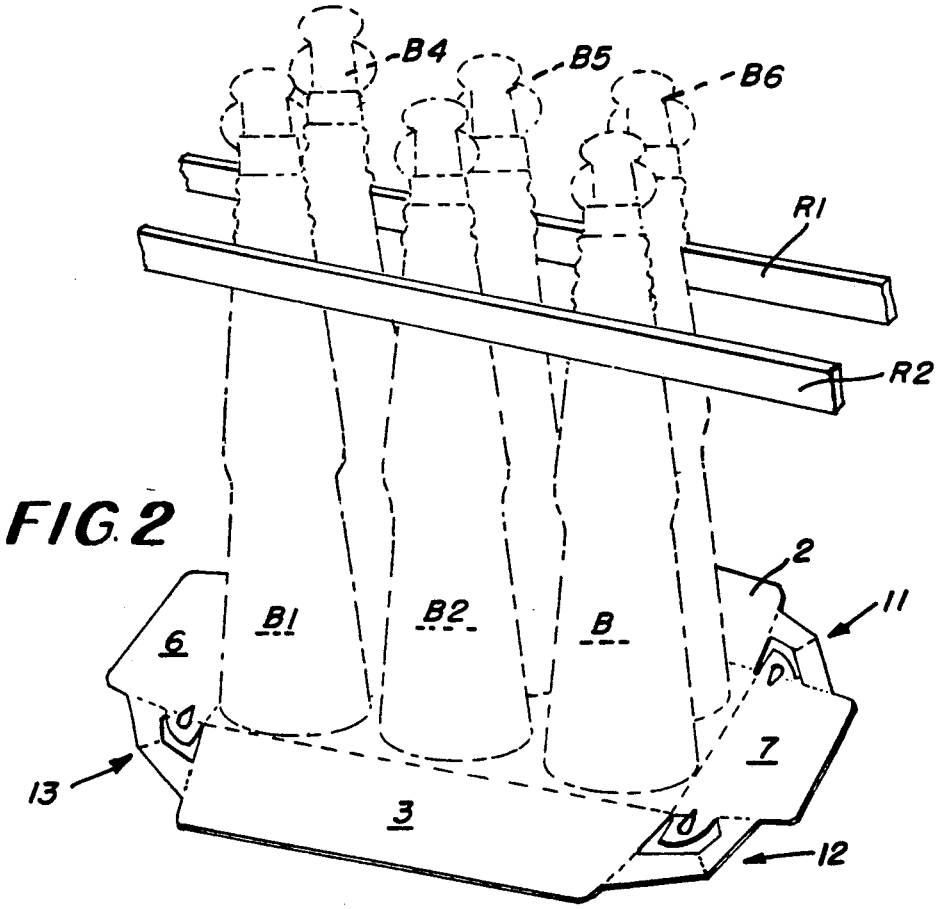
FIG. 2 is a perspective view of a blank such as is shown in FIG. 1 in which a plurality of containers are disposed atop the bottom panel.

In order to load and set up the carton blank as shown in FIG. 1, a plurality of articles such as bottles B1–B6 inclusive are arranged in two rows of three bottles each atop the main panel 1 as shown in FIG. 2. Guide rails R1 and R2 are disposed alongside the upper portions of the bottles B1–B6 so as to prevent sidewise dislodgement of the bottles from their proper positions atop main panel 1.

The claims define the side and end walls in terms which may tend to indicate that this invention is limited to particular combinations of side or of end walls. In this connection it will be understood that the terms end wall and side wall are interchangeable as far as the scope of this invention is concerned. While the invention is shown as a tray, it is within the purview of this development that it may also be used as a cover.

I claim:

1. Corner structure for a container formed from a unitary blank, said corner structure comprising a quadrilateral main panel with right angle corners, an end wall foldably joined to an end edge of said main panel, a side wall foldably joined to a side edge of said main panel which intersects said end edge of said main panel, said end wall and said side wall having adjacent end edges, a locking tab foldably joined to an end edge of said end wall said locking tab having an aperture which extends into the associated end wall and which includes an engagement edge which is engageable by a machine element to begin insertion of the locking tab which is disposed in flat face contacting relation with the adjacent side wall panel, a retention slit struck from said locking tab and forming a projection from the adjacent end edge of said end wall, and collapsible web structure joined at its ends to said adjacent end edges respectively along fold lines one of which terminates at a point spaced from an end edge of said web structure to accommodate a locking slit extending from an end edge of said web structure, said locking slits and said retention slits in snug proximity to each other and with a portion of each of said locking tabs in contacting relation with the part of said collapsible web structure which is adjacent to said retention slit.

2. Corner structure for a container formed from a unitary blank, said corner structure comprising a quadrilateral main panel with right angle corners, an end wall foldably joined to an end edge of said main panel, a side wall foldably joined to a side edge of said main pane which intersects said end edge of said main panel, said end wall and said side wall having adjacent end edges, a locking tab foldably joined to an end edge of said end wall, said locking tab having an aperture with an outer edge and an engagement edge which is engageable by a machine element to being insertion of the locking tab which is disposed in flat face contacting relation with the adjacent side wall panel, a retention slit struck from said locking tab and forming a projection from the adjacent end edge of said end wall, collapsible web structure having an inner edge and being joined at its ends to said adjacent end edges respectively along fold lines one of which terminates at a point spaced from an end edge of said web structure to accommodate a locking slit extending from an end edge of said web structure, said locking slits and said retention slits in snug proximity to each other and with a portion of each of said locking tabs in contacting relation with the part of said collapsible web structure which is adjacent to said retention slit, and an aperture defined by the inner edge of said web structure and the outer edge of said locking tab to accommodate folding movement of said locking tab.

3. Corner structure for a blank for forming at least a portion of a container, said corner structure comprising:

a main panel having at least one corner with first and second end edges extending therefrom;

an end wall foldably joined to said first edge of said main panel and having an end edge extending outwardly with respect to said corner;

a side wall foldably joined to said second edge of said main panel and having an end edge extending outwardly with respect to said corner;

a web structure joined at its ends to said end edges of said end and side walls along said first and said second fold lines respectively, said web structure being spaced from said corner to define an open area therebetween and an inner edge for said web structure with respect to said corner;

a locking tab foldably joined to said end edge of said end wall along a third fold line and disposed within said open area and defining an outer edge with respect to said corner;

a locking slit formed into said outer edge of said locking tab and extending generally inwardly with respect to said corner;

a retention slit formed into said inner edge of web structure generally along said second fold line and extending generally outwardly with respect to said corner;

said locking tab having an aperture formed therein which extends across a portion of said third fold line and partially into said end wall to define an engagement edge to facilitate manipulation of said locking tab by a machine element as said corner structure is set up.

4. Corner structure as defined in claim 3, wherein said aperture is generally teardrop shape having a relatively wide end disposed within said locking tab and a generally narrow end disposed within said end wall.

5. Corner structure for a container formed at least partially from a unitary blank, said corner structure comprising:

a main panel having at least one corner with first and second end edges extending therefrom;

an end wall foldably joined to said first edge of said main panel and having an end edge extending generally away from said corner;

a side wall foldably joined to said second edge of said main panel and having an end edge extending generally away from said corner and generally adjacent said end edge of said end wall;

a collapsible web structure joined at its ends to said end edges of said end and side walls along first and second fold lines respectively, said web structure being spaced from said corner;

a locking tab disposed in overlapping contact relationship with said side wall and foldably joined to said end edge of said end wall along a third fold line disposed therealong between said web structure and said corner;

a locking slit formed into an edge of said locking tab and extending generally toward said corner;

a retention slit formed into said inner edge of web structure generally along said second fold line and extending generally away from said corner, said locking and retention slits being positioned in mutual engagement to maintain said locking tab in position with respect to said side wall;

said locking tab having an aperture formed therein to define an engagement edge to facilitate manipulation of said locking tab by a machine element as said corner structure is set up said aperture extending across a portion of said third fold line and partially into said end wall.

6. Corner structure as defined in claim 5, wherein said aperture is generally teardrop shape having a relatively wide end disposed within said locking tab and a generally narrow end disposed within said end wall.

* * * * *

UNITED STATES PATENT AND TRADEMARK OFFICE

CERTIFICATE OF CORRECTION

PATENT NO. : 5,326,018

DATED : July 5, 1994

INVENTOR(S) : Gary W. Baugus

It is certified that error appears in the above-identified patent and that said Letters Patent is hereby corrected as shown below:

Column 3, line 46, "pane" should read -- panel --;

Column 3, line 51, "being" should read -- begin"

Signed and Sealed this

Fourth Day of April, 1995

*Attest:*

*Attesting Officer*

BRUCE LEHMAN

*Commissioner of Patents and Trademarks*